US006131872A

United States Patent [19]

Ford

[11] Patent Number: 6,131,872

[45] Date of Patent: Oct. 17, 2000

[54] ARTICLE SUPPORTING DEVICE

[76] Inventor: Alan Ford, P.O. Box 1284, Bromhof 2154, South Africa

[21] Appl. No.: 09/291,812

[22] Filed: Apr. 14, 1999

[51] Int. Cl.[7] ..... A47B 97/04

[52] U.S. Cl. ..... 248/453; 248/453; 248/910; 248/447; 248/688

[58] Field of Search ..... 248/453, 910, 248/688, 446, 447, 451, 123.2

[56] References Cited

U.S. PATENT DOCUMENTS

| | | | |
|---|---|---|---|
| 90,870 | 6/1869 | Poulson | 248/453 |
| 359,056 | 3/1887 | Brower | 248/453 |
| 508,224 | 11/1893 | Kaupmann | 248/447 |
| 692,612 | 2/1902 | Burt | 248/451 |
| 2,203,126 | 6/1940 | Bell et al. | 248/447 |
| 2,386,131 | 10/1945 | McCutchan | 248/447 |
| 2,503,015 | 4/1950 | Weisheit | 248/453 |
| 2,572,731 | 10/1951 | Keith | 248/457 |
| 4,123,029 | 10/1978 | Gillotti | 248/453 |
| 4,886,231 | 12/1989 | Doerksen | 248/455 |
| 5,765,799 | 6/1998 | Weber | 248/453 |
| 5,893,546 | 4/1999 | Renfroe | 248/451 |

*Primary Examiner*—Anita M. King
*Assistant Examiner*—Naschica C Sanders
*Attorney, Agent, or Firm*—Theodore J. Bielen, Jr.

[57] ABSTRACT

A device placable on a surface for positioning an article for viewing utilizing a base member. The base member includes a first portion and an angularly attached second portion. The first portion and second portions are capable of rotating about an axis. The first portion includes a biasing weight which causes projection of the second portion of the base member outwardly. The second portion of the base member includes a protuberance which extends from the surface of the second portion of the base member. A bracket is held by the first portion of the base member and extends to the vicinity of the protuberance. The article engages and disengage by rocking the base member about the axis causing the bracket either to contact the protuberance and or to separate from the protuberance.

9 Claims, 2 Drawing Sheets

ARTICLE SUPPORTING DEVICE

BACKGROUND OF THE INVENTION

The present invention relates to a novel and useful support for positioning an article for viewing.

Items such as papers, books, photos, and the like are readily used in many situations by supporting the same in an upright position relative to a working surface. In the past, this has been achieved by stands having clips, magnets, adhesive tapes, and the like which are generally used to hold the article against a placard. Although useful in many instances, such article supports are bulky and require multiple steps to place and remove the article therefrom.

A support which is placeable on a surface which can easily hold or remove an article for viewing in an upright position would be a notable advance in the business and industrial arts.

SUMMARY OF THE INVENTION

In accordance with the present invention a novel and useful support for an article is herein provided.

The support of the present invention is intended to be placed on a surface. The support includes a base member which is generally divided into a first portion and a second portion that is angularly attached to the first portion. The base member also includes a crease which is generally formed along an axis. The first and second portions may rotate about the axis through the application and removal of pressure on the second portion. In this aspect of the invention, the first portion may also be provided with weight means for biasing the first portion against the surface. Thus, the second portion of the base member normally projects outwardly and upwardly from the surface to present engagement of the same, generally by the finger of the user.

A protuberance is formed to extend from the second portion of the base member. The protuberance may take the form of a slender rod-like member, and project outwardly a sufficient distance to engage an article for holding and viewing.

The present support is also constructed with a bracket which is held by the first portion of the base member. The bracket may include a rod or shaft portion extending upwardly and outwardly from the base member and terminating an end piece having wings, which extend laterally relative to the rod or shaft portion. The bracket shaft is slidingly held to the first portion of the base member by a bushing which also extends outwardly from the base member. The bushing includes a bore extending through the base member to allow the shaft of the bracket to contact the surface and to allow the shaft to extend outwardly from the base member when the first portion of the base member is tipped upwardly. Such tipping also allows the bracket end portion to engage the protuberance of the second portion of the base member in order to squeeze or sandwich and article such as a paper, photo, book, and the like, and to hold the same in an upward position. The weight means biasing the second portion of the base member maintains such squeezing contact during use of the support of the present invention.

It may be apparent that a novel and useful support for positioning an article for viewing has been herein described.

It is therefore an object of the present invention to provide a support for viewing an article which is compact and usable on small area surfaces.

Another object of the present invention is to provide a support for positioning an article for viewing which is easily operable by the simple application of downward pressure on a portion of the same followed by a release.

A further object of the present invention is to provide a support for positioning an article for viewing which includes a minimum of moving parts and is easily assembled for use.

A further object of the present invention is to provide a support for positioning an article which is simple to manufacture and repair, exhibiting great durability during use.

The invention possesses other objects and advantages especially as concerns particular characteristics and features thereof which will become apparent as the specification continues.

Figure 2:
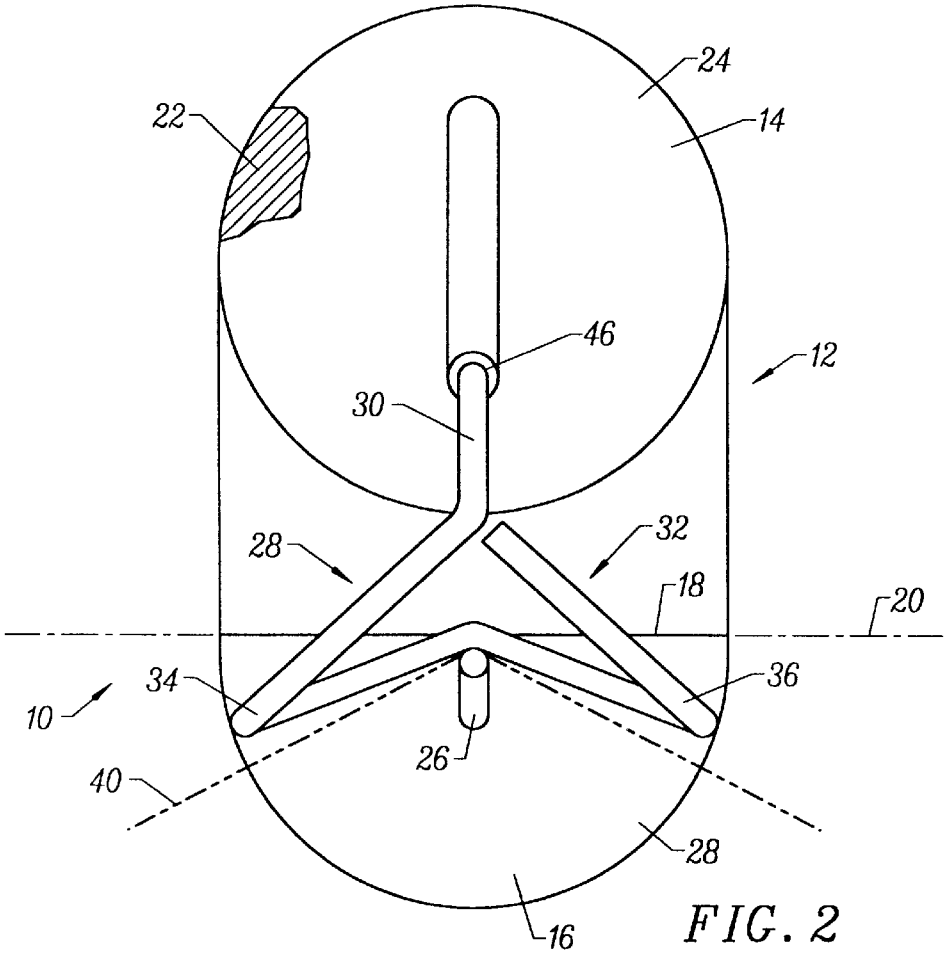
FIG. 2 is a top plan view of the support of the present invention with a broken away portion of the base member revealing weight means.
Figure 1:
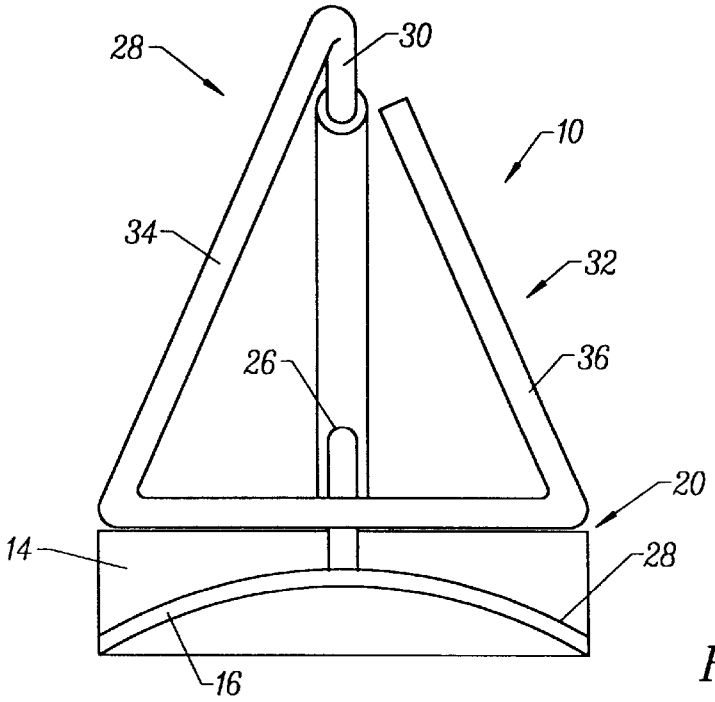
FIG. 1 is a front elevational view of the support of the present invention.

For a better understanding of the invention reference is made to the following detailed description of the preferred embodiments thereof which should be compared to the prior described drawings.

DETAILED DESCRIPTION OF THE PREFERRED EMBODIMENTS

Various aspects of the present invention will evolve from the following detailed description of the preferred embodiments thereof which should be taken in conjunction with the hereinabove described drawings.

The invention as a whole is shown in the drawings by reference character 10, FIGS. 1–4. Device 10 includes as one of its elements a base member 12 having a first portion 14 and a connected second portion 16. First and second portions 14 and 16 of base member 12 connect to each other along a crease 18 which is generally coincident with an axis 20. Since first portion 14 and second portion 16 of base member 12 are angularly related to one another, base member 12 is able to rock about axis 20, the importance of which will become apparent as the specification continues.

First portion 14 of base member 12 includes weight means 22 which may be a metallic member fixed to first portion 14 of base member 12, which possesses a disk-shaped housing 24. Of course, weight means 22 may be formed in any other manner, be it internally or externally fixed to housing 24. However, in the present embodiment, weight means 22 is found within disk-shaped housing 24 for the sake of compactness and neatness.

Protuberance 26 is also found in the present invention attached to the upper surface 27 at second portion 16 of base member 12. Protuberance 26 is rigid or semirigid in this regard.

A bracket 28 is also included in the present invention.

Bracket 28 is provided with a shaft 30 and an end piece 32 having wings 34 and 36. As may be observed from FIGS. 1 and 2, bracket 28 is angulated between shaft 30 and end piece 32.

Figure 3:
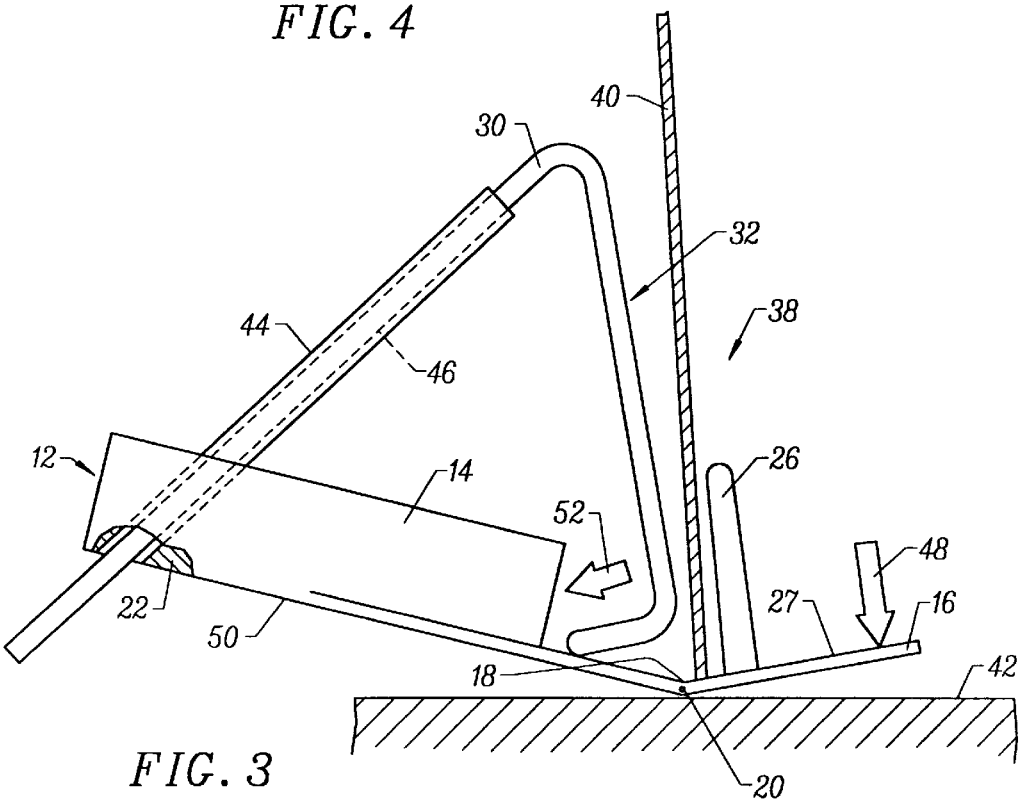
FIG. 3 is a side elevational view of the support of the present invention with pressure being applied to prepare the support for holding an article.

Means 38 is also included in the present invention for engaging and disengaging an article 40, depicted in FIGS. 2 and 4 as a dashed line and in part in FIG. 3. Article 40 may be a piece of paper, a photo, a book, or other items that the user wishes to support in upright position. Means 38 is capable of urging bracket 28 toward protuberance 26 when weight means 22 biases first portion of 14 of base member 12 toward a surface 42. Means 38 may take the form of a bushing 44 held by base member first portion 14. Bushing 44 includes a bore 46 therethrough. Bushing 44 extends through housing 24 and to the interface between base member 12 and surface 42. Needless to say, shaft 30 of bracket 28 is free to move within the bore 46 of bushing 44. In other words, shaft 30 of bracket 28 slidingly extends through bore 46 of bushing 44.

Figure 4:
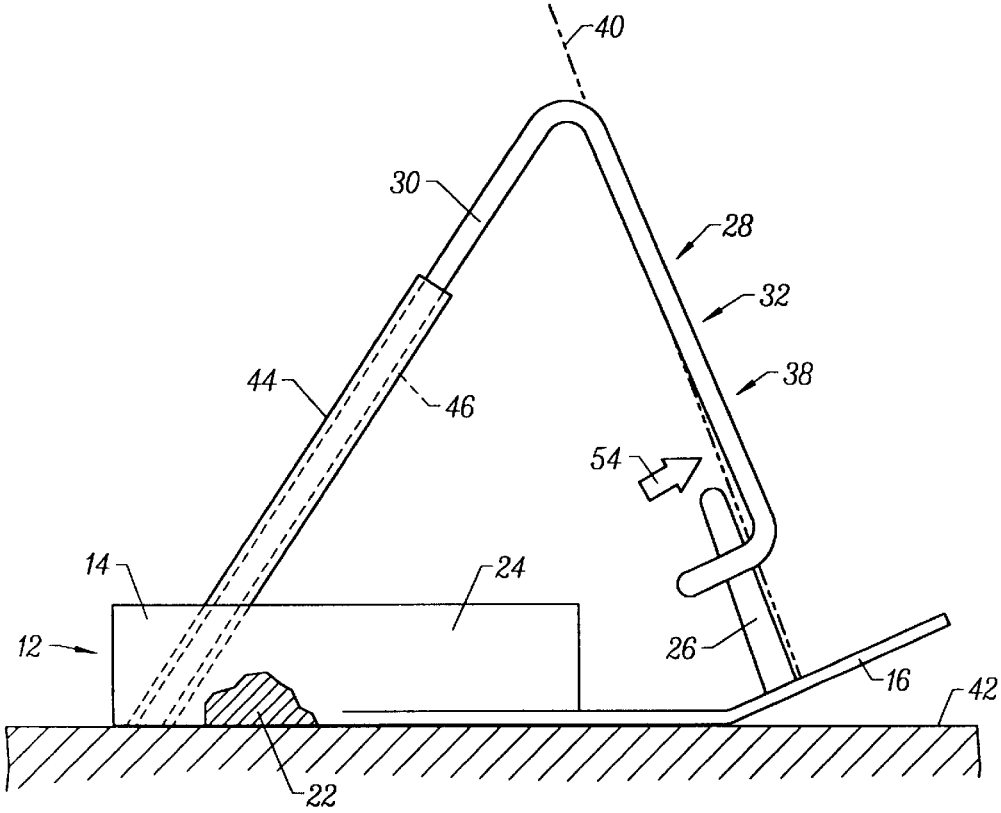
FIG. 4 is a side elevational view of the support of the present invention with the pressure having been released and the article supported being represented in dash configuration.

In operation, reference is made to FIGS. 3 and 4 in which pressure is indicated as being applied to surface 27 of second portion 16 of base member 12, directional arrow 48. Upon the application of downward pressure according to directional arrow 48, base member 12 rocks or tips about axis 20 at crease 18. Such rocking permits shaft 30 to extend downwardly to bore 46 of bushing 44 and outwardly from the bottom surface 50 of first portion 14 of base member 12. Such movement of shaft 30 of bracket 28 also moves end piece 32 away from its contact with protuberance 26, directional arrow 52. Thus, article 40 may be placed between protuberance 26 and end piece 32 of bracket 28. Release of pressure, directional arrow 48, from surface 27 of second portion 16 of base member 12 allows base member 12 to rock backwardly, FIG. 4. When this occurs, shaft 30 is pushed upwardly through bushing 44 and end piece 32 is moved outwardly, directional arrow 54, into contact with protuberance 26 squeezing article 40 in place. Thus, article 40 is held in this position since weight means 22 urges first portion 14 of base member 12 downwardly to the position shown in FIG. 4. Article 40 may now be viewed by the user as desired.

While in the foregoing, embodiments of the present invention have been set forth in considerable detail for the purposes of making a complete disclosure of the invention, it may be apparent to those of skill in the art that numerous changes may be made in such detail without departing from the spirit and principles of the invention.

What is claimed is:

1. A support placeable on a surface for positioning an article for viewing, comprising:

a. a base member, said base member including a first portion and a second portion angularly attached to said first portion, said base member first and second portions rotating about an axis;

b. a protuberance extending from said second portion of said base member;

c. weight means for biasing said first portion of said base member to the surface and rotating said second portion of said base member outwardly from the surface;

d. a bracket held by said first portion of said base member; and e. article engaging and disengaging means for urging said bracket toward said protuberance when said weight means biases said first portion of said base member to the surface, and for urging said bracket away from said protuberance when said first portion is moved away from the surface.

2. The support of claim 1 in which said article engaging and disengaging means includes a bore through said first portion of said base member, and said bracket including a shaft slidingly extending through said bore through said first portion of said base member.

3. The support of claim 2 in which said second portion of said base member includes a bushing providing said bore through said first portion of said base member.

4. The support of claim 2 in which said shaft of said bracket slidingly extends through said bushing.

5. the support of claim 1 in which said bracket includes an end piece having first and second wings, said first and second wings being angularly oriented relative to one another.

6. The support of claim 5 in which said article engaging and disengaging means includes a bore through said first portion of said base member, and said bracket including a shaft slidingly extending through said bore through said first portion of said base member.

7. The support of claim 6 in which said second portion of said base member includes a bushing providing said bore through said first portion of said base member.

8. The support of claim 7 in which said shaft of said bracket slidingly extends through said bushing.

9. The support of claim 8 in which said axis lies along a crease of said base member between said first and second portions.

* * * * *